US007234175B2

(12) United States Patent
Wilson et al.

(10) Patent No.: US 7,234,175 B2
(45) Date of Patent: Jun. 26, 2007

(54) LAVATORY CLEANSING DEVICES

(76) Inventors: Brian Wilson, 52 Common Road, Bressingham, Diss, Norfolk IP22 2BB (GB); Steve Nicol Balls, 42 Thistle Close, Thetford, Norfolk IP24 2YB (GB); Paul Pleasance, 9 Mill Close, Walsham-le-Willows, Bury St Edmunds, Suffolk IP31 3BW (GB); Rachel Sobiechowski, 40 Malsters Close, Mundford, Thetford, Norfolk IP24 5HJ (GB)

( * ) Notice: Subject to any disclaimer, the term of this patent is extended or adjusted under 35 U.S.C. 154(b) by 0 days.

(21) Appl. No.: 10/835,988

(22) Filed: Apr. 30, 2004

(65) Prior Publication Data

US 2004/0199985 A1 Oct. 14, 2004

Related U.S. Application Data

(63) Continuation of application No. 10/073,539, filed on Feb. 11, 2002, now abandoned.

(30) Foreign Application Priority Data

Feb. 9, 2001 (GB) ..... 0103283.8

(51) Int. Cl.
*E03D 9/02* (2006.01)

(52) U.S. Cl. ..... 4/231

(58) Field of Classification Search ..... 4/223, 4/231

See application file for complete search history.

(56) References Cited

U.S. PATENT DOCUMENTS

| | | | | |
|---|---|---|---|---|
| 623,334 | A | 4/1899 | Perkins | |
| 1,067,472 | A | 7/1913 | Creed | |
| 3,504,384 | A | 4/1970 | Etal | |
| 3,766,576 | A | 10/1973 | Ancel | |
| 3,946,448 | A | 3/1976 | Sioufy | |
| 4,168,551 | A | 9/1979 | Hautmann et al. | |
| 4,200,606 | A | 4/1980 | Kitko | |
| 4,248,827 | A | 2/1981 | Kitko | |
| 4,777,670 | A | 10/1988 | Klinkhammer et al. | |
| 5,034,150 | A | 7/1991 | Smith | |
| 6,178,564 | B1 * | 1/2001 | Leonard et al. | 4/223 |
| 6,389,610 | B1 | 5/2002 | Hautmann et al. | |
| 6,510,561 | B1 | 1/2003 | Hammond et al. | |

FOREIGN PATENT DOCUMENTS

| | | | |
|---|---|---|---|
| EP | 0137551 | A1 | 4/1985 |
| EP | 0233666 | A1 | 2/1987 |
| EP | 0538957 | B1 | 3/1996 |
| EP | 0785315 | A1 | 7/1997 |
| EP | 0960984 | A2 | 12/1999 |
| FR | 2579647 | A1 | 10/1986 |
| GB | 1466560 | | 3/1977 |
| GB | 2316420 | A | 2/1998 |

(Continued)

*Primary Examiner*—Robert M. Fetsuga
(74) *Attorney, Agent, or Firm*—John F. McKenna; Cesari & McKenna, LLP

(57) ABSTRACT

A liquid dispensing unit for a toilet bowl comprises a first container containing a first, liquid formulation, a second container containing a second formulation, which may be a solid tablet. The liquid from container flows onto a delivery surface from where it is washed into the toilet bowl by the flush water. Some flush water also washes over the second formulation to take components into solution and deliver them into the toilet bowl through aperture. The constituents of the two formulations are thus kept separate until they enter the toilet bowl. The second formulation may also be a liquid.

11 Claims, 9 Drawing Sheets

FOREIGN PATENT DOCUMENTS

| | | | |
|---|---|---|---|
| GB | 2349157 | A | 10/2000 |
| WO | WO 9966139 | A1 | 12/1999 |
| WO | WO 9966140 | A1 | 12/1999 |
| WO | WO 0102653 | A1 | 1/2001 |
| WO | WO 0240787 | A1 | 5/2002 |
| WO | WO 0240791 | A1 | 5/2002 |
| WO | WO 0240792 | A1 | 5/2002 |
| WO | WO 03060245 | A1 | 7/2003 |
| WO | WO 03078747 | A1 | 9/2003 |

* cited by examiner

LAVATORY CLEANSING DEVICES

CROSS-REFERENCE TO RELATED APPLICATION

This application is a continuation of Ser. No. 10/073,539, filed Feb. 11, 2002, now abandoned.

BACKGROUND OF THE INVENTION

1. Field of the Invention

This invention relates to lavatory cleansing devices for delivering fragrance and cleansing products to a lavatory bowl. The invention is particularly concerned with devices delivering a liquid product such as a perfume, surfactant or disinfectant, particularly in the form of a solution, dispersion or suspension, together with a bleach, or other relatively aggressive product such as a limescale remover, and for delivering it to a toilet bowl under the action of water used to flush the toilet bowl.

2. Description of the Prior Art

It has been known for a long time to provide so-called toilet automatics in the form of a solid or semi-solid product, a 'rim block', to be mounted within the inner rim of a water closet bowl where the flushing water will wash over the product and so dissolve or erode it to release active constituents into the water flow. Blocks may also be placed on top of the cistern in Japanese style systems where water from a tap flows over the block and then into the cistern, and also may be placed within the cistern below the water level, where they slowly release constituents into the water.

These products have long been used to deliver a surfactant, a perfume and a dye to the toilet bowl. The surfactant provides a cleaning action, while the dye and perfume provide a visual and olfactory indication to the user that some cleansing effect is being achieved. Much effort has also been put into formulating rim blocks which will also deliver a bleaching agent, such as sodium dichloroisocyanurate, to the toilet bowl and these have been successfully developed and marketed by the present applicants.

Different considerations apply when formulating products which dose the water in the cistern and products which dose directly into the toilet bowl. With a solid block, the block will be completely immersed in water when used in the cistern, but will be exposed only intermittently to flush water when used in the toilet bowl.

Many different mechanisms have been proposed for dosing solid or liquid formulations into the cistern, making use of movement of water in the cistern. For dosing directly into the toilet bowl, the long used system has been a solid block which is housed in a cage suspended in the path of the flush water as it enters the bowl.

More recently, products have been developed for dosing a liquid toilet freshening product directly into the toilet bowl, in a similar manner to rim blocks, providing a so-called liquid rim product. For example, EP-A-0 538 957 describes a device that can be mounted on the inner rim of a water closet bowl to dose a liquid freshening product into the flushing water. In this device, the liquid product is dosed into the water flow from a porous substrate, forming a delivery plate which is disposed in the path of the flushing water. The porous substrate is supplied with the liquid product from a container disposed above the substrate, a mouth at the bottom of the container has a liquid permeable plug which opens onto the upper surface of the substrate.

EP-A-0 785 315 describes a development of the device discussed above. The same basic principle of delivering a liquid product into a flow of water from a porous substrate is employed. However, liquid product from the container is deposited onto the upper surface of the substrate via a regulating channel. The liquid is metered into the channel through an orifice and a separate opening allowing air into the interior of the container is provided. The sizes of the metering orifice and the air opening are related to the viscosity of the liquid being dosed.

WO 99/66139 and WO 99/66140 describe numerous variations of the liquid rim product, including different styles of delivery plate in place of the porous plate of EP-A-0 538 957, while WO 00/42261 describes a design which uses a grooved plate.

All of the above systems use the same basic idea of delivering liquid directly from the container's mouth onto the delivery plate.

Further developments of the liquid rim system are described in co-pending applications Nos. GB 0026832.6 and WO 01/32995 which are incorporated herein by reference.

EP-A-775 741 describes a liquid formulation suitable for use in liquid rim products. This formulation comprises perfume, anionic or non-ionic surfactant, evaporation regulator and a solvent. EP-A-775 741 also mentions that a bleaching or disinfecting agent, such as hypochlorite, peroxide or isocyanurate can be incorporated in the liquid formulation but no actual formulation is described.

A problem with bleach formulations, whether of the liquid or solid type, is that the bleach can have an adverse effect on other constituents in the formulation and on the delivery device itself, particularly where it is desirable to use a transparent container so that the user can see the color of the formulation, and can also see when the supply is nearly exhausted and a refill is required. For example, good quality perfumes are not compatible with bleaches. Typically, PVC and PET are used for moulding liquid rim devices, but high density polyethylene or polypropylene would be preferred materials for a bleach system.

SUMMARY OF THE INVENTION

We overcome the above problems by providing a liquid rim product in which separate sources of agents which are generally incompatible, such as a bleaching agent or limescale remover, on the one hand, and a surfactant, dye and/or perfume on the other hand, are provided. This has the benefit of not only simplifying the formulation of the sources themselves, but also giving greater flexibility in the manufacture of the delivery device.

It has been suggested to separate incompatible constituents when utilizing solid or liquid compositions, such as described in U.S. Pat. No. 3,504,384, U.S. Pat. No. 4,200,606 and U.S. Pat. No. 4,248,827 which are dosed into the toilet cistern, but no successful commercial application of this idea has been achieved. We believe there has been no suggestion of using separate sources of material when dispensing a liquid formulation at the rim of the toilet bowl, or incorporating solid and liquid formulations in a rim dispensing device.

One aspect of the present invention provides a lavatory cleansing device for use in a toilet bowl comprising a first container containing a first, liquid formulation and a second container containing a second formulation, and delivering means for automatically delivering the formulations under the action of flush water.

Preferably, the delivery means comprises a delivery surface, the first formulation being delivered onto the delivery surface, and flush water of the toilet runs over the delivery surface to carry the first formulation into the water in the toilet bowl. Very preferably the first and second formulations are kept substantially separate by the delivery means and so do not come into contact until they have mixed with the flush water. In particular, it is desired that the formulations do not come into substantial contact at the lavatory cleansing device in between flushes of the toilet bowl.

In another form, a wick may extend into a container containing the or a liquid formulation and the liquid formulation is drawn from the container by flush water running over the wick. DE-A-3 419 169 describes such devices.

As noted above, the second formulation may be an acidic formulation. Such formulations are intended, in particular, to reduce limescale formation and build up in the toilet bowl.

It has been found that a delivery system using a textile surface can provide for a faster and better spread of a viscous liquid over a dosing area, as compared to a porous substrate or grooved plate of the prior art. Without wishing to be bound by theory, it is believed that the relatively fine surface structure of the textile surface may contribute to the improved spreading characteristics.

The better spread of the viscous liquid counters its greater resistance to dissolution and dispersal in the flushing water, as compared to the more easily dispersed low viscosity liquids.

Very preferably the viscous liquid is not absorbed, or not absorbed substantially into the textile and so it is washed off more readily by flushing water in a toilet bowl, or evaporates more readily to atmosphere to provide improved fragrance. A hydrophobic textile is preferred.

Textile material is a material or fabric made from fibers, yarns or filaments (herein referred to generally as fibers). The material may be non-woven, in which fibers are bonded, fused or interlocked, but a material made by interweaving, intertwining or interlooping (referred to generally herein as weaving or knitting) is preferred.

The material may be of quite dense structure when seen in plan, so as to present a substantially continuous surface, with few if any voids between adjacent fibers. Although an open weave structure has also been found to work well. By virtue of the weaving or knitting process, the textile will have a textured or three dimensional surface.

The surface of the material may be compacted, that is with few fibers or fibrous elements projecting from the surface, and the surface texture having a low profile or height.

One textile material which may be used is a polyester knitted fabric such as used for net curtain material or heavier use such as filter material.

Some degree of trial and experimentation may be required to match the textile material and weave to the viscosity and surface tension of the liquid, and the physical design parameters of the delivery device.

A liquid component can be delivered from a container directly onto the delivery surface or the upper surface of the fabric from above, for example using devices of the type seen in EP-A-538 957, WO 99/66139 and WO 00/42261. However, it is particularly preferred to deliver the liquid from a cup located below the delivery surface or fabric. A capillary system then delivers the liquid up on to the delivery surface or fabric surface. The capillary may be a series of grooves or channels, a porous member, or a wick of cellulose, polyester or the like as used in air fresheners, for example. A system for delivering liquid onto the upper surface of a delivery plate is described in co-pending application No. WO 01/32995. Such a system is suitable for use with the fabric or textile surface, which is described in more detail in co-pending application No GB 0026832.6.

The second formulation, preferably a bleach or acid formulation, may be a liquid also, and may be delivered using a mechanism similar to those described above. However, it is particularly preferred that the second formulation is a solid and is housed adjacent the container for the non-bleach containing formulation. The solid formulation may be a single block or tablet or several tablets, pellets, granules, etc. The second formulation may also be a paste or gel.

Preferably, the tablet(s), pellets, granules etc. are housed in a substantially enclosed space which has openings to allow flushing water to enter the space and wash out some of the components into the lavatory cistern, but will inhibit access by the user in normal use. Pellets or granules may conveniently be held in a mesh bag.

More preferably, flush water is held in contact with the solid formulation for a short period of time before passing into the toilet bowl. This ensures sufficient time to dissolve constituents of the formulation, and also that the solution is delivered at the end of the flushing cycle and so is not immediately carried out of the toilet bowl by the flushing water.

The solid formulation may contain a dye or colorant. Although a colorant may be used in a liquid formulation, to give an intense color in the toilet bowl a high concentration is required. This may lead to unsightly staining when delivering from a liquid product. By providing a solid colorant containing component, release of the dye is better controlled. The blocks may contain dye, surfactant and a filler, similar in composition to the well known 'BLOO' (trade mark) blocks.

By providing separate formulations, it is possible to provide a delivery mechanism which is better tailored to the properties of the different components of the formulations. This is particularly important with bleaching agents because these agents can cause problems if they are not handled properly. Care must be taken when formulating bleaching compositions to avoid instability during manufacture or on shelf, while the delivery mechanism should ensure minimum risk of contact with the user and avoid any noticeable degradation of the product, such as discoloring of any dye component during use.

Thus, for example, we can provide a solid bleach formulation which will have a long shelf life and can, in use, deliver bleach over the requisite period, typically 3 weeks or more.

By realizing that the bleach component can and should be delivered separately to the other cleansing or freshening components in a liquid rim device, we are able to obtain substantial improvements in the manufacture, storage and in-use delivery of these components.

It is possible to provide a solid formulation which can have limited contact by the user and so the enclosure may have a removable cover, for example, to allow refill by a user.

It will be appreciated that liquid refills are readily provided for, the liquid and container being replaced as a single unit.

It is particularly preferred that the refill comprises the combination of the liquid container and the solid cage provided as a single unit.

Aspects of the invention are set forth in the accompanying claims.

BRIEF DESCRIPTION OF THE DRAWINGS

The invention will be further described by way of example only, with reference to the accompanying drawings, in which.

DETAILED DESCRIPTION OF AN ILLUSTRATIVE EMBODIMENT

Figure 8:
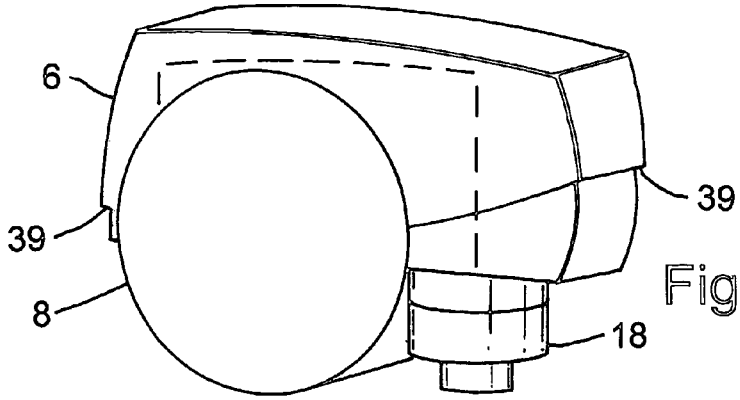
FIG. 8 is a perspective view of a refill for the device of FIG. 1.

In the embodiment of FIGS. 1 to 8, a lavatory cleansing device 2 comprises a main support member 4 which carries a container 6 containing a liquid formulation 5 (see FIG. 5) and a cage 8 which houses a solid formulation. Container 6 and cage 8 are clipped together and are removable from the main support member 4. The combination of container 6 and cage 8 form a refill, as seen in FIG. 8. The components of support member 4 to be described constitute the delivery means for delivering the liquid and solid formulations from container 6 and cage 8 to the toilet bowl.

Support member 4 has a folded strap 10 on its rear wall 16. Strap 10 is unfolded and hooked over the rim of a toilet bowl, as is well known in the art. Strap portion 10*a* will bear against the inner wall of the toilet rim (see FIG. 16).

Figure 2:
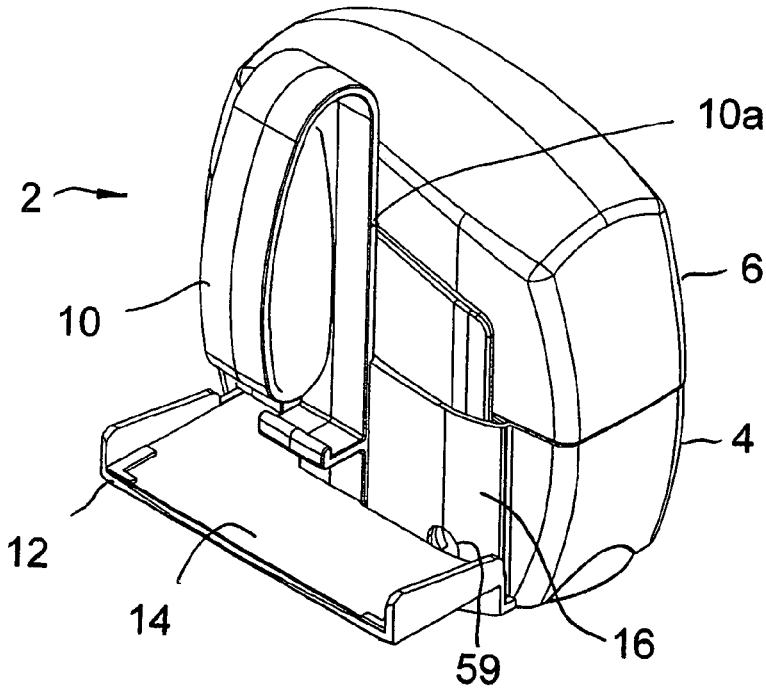
FIG. 2 is a rear perspective view of the device of FIG. 1.
Figure 3:
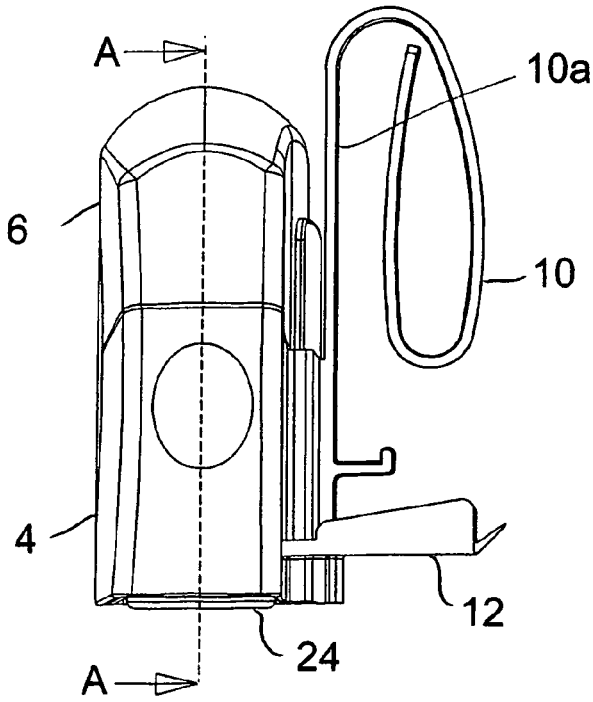
FIG. 3 is a side view of the device of FIG. 1.
Figure 4:
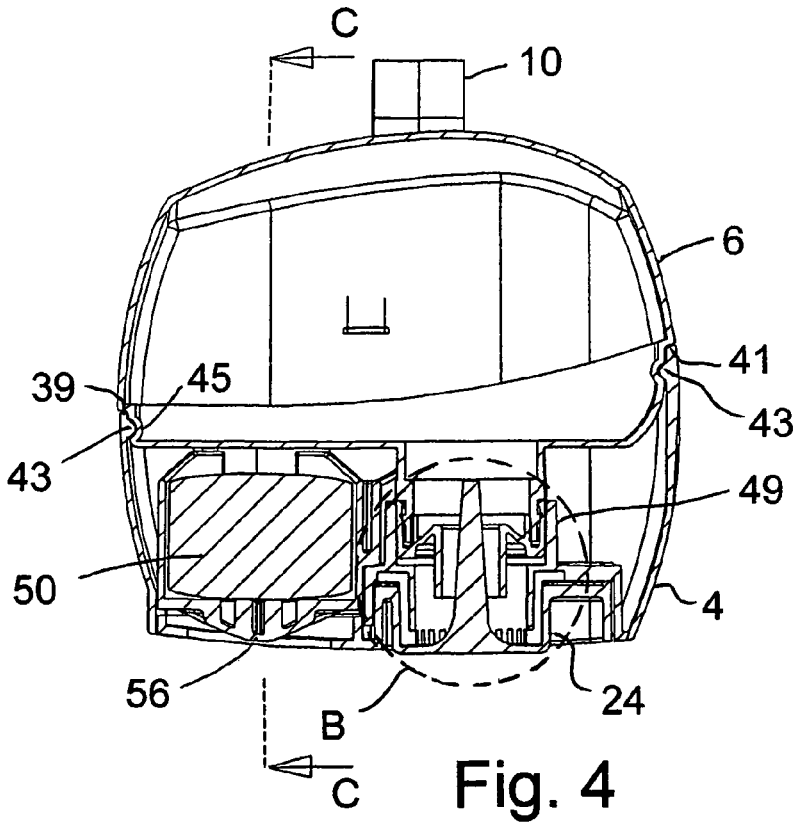
FIG. 4 is a cross-section along the line A—A of FIG. 3.
Figure 5:
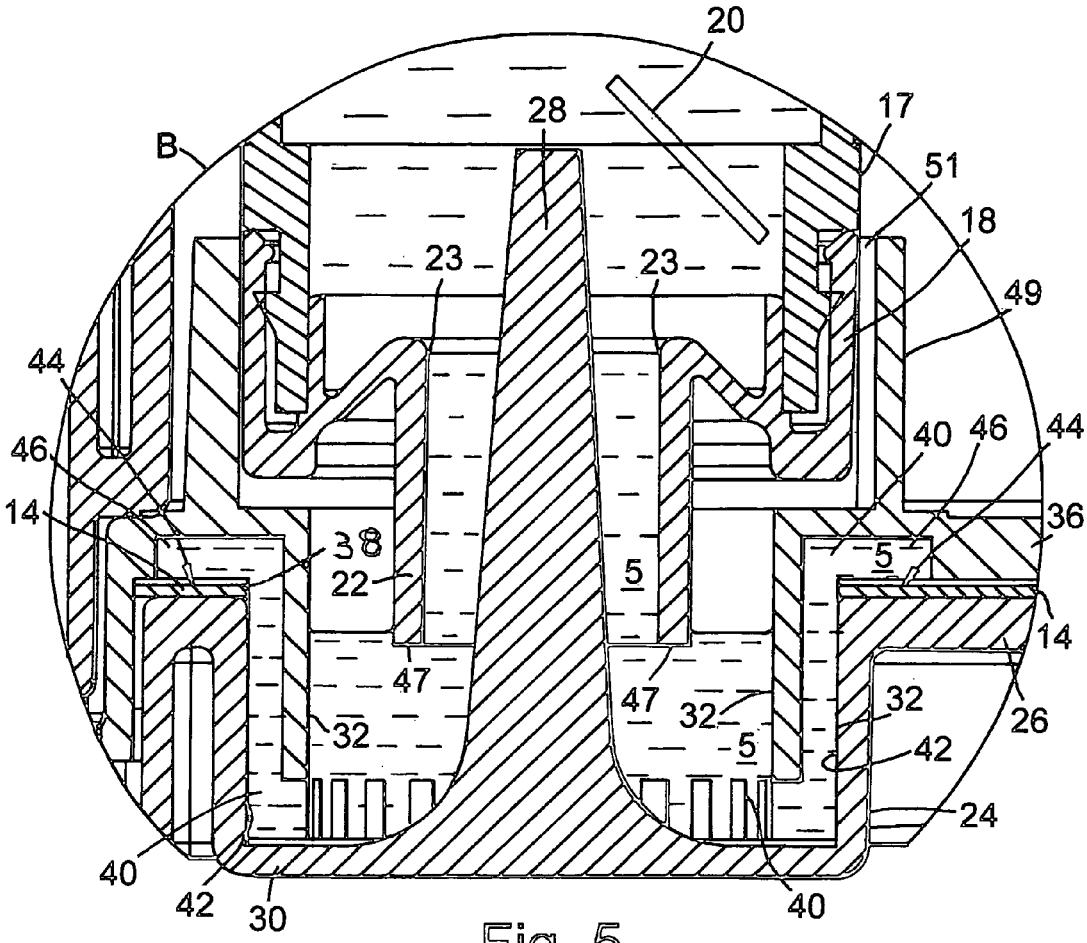
FIG. 5 is an enlarged detail of FIG. 4, on circle B.
Figure 6:
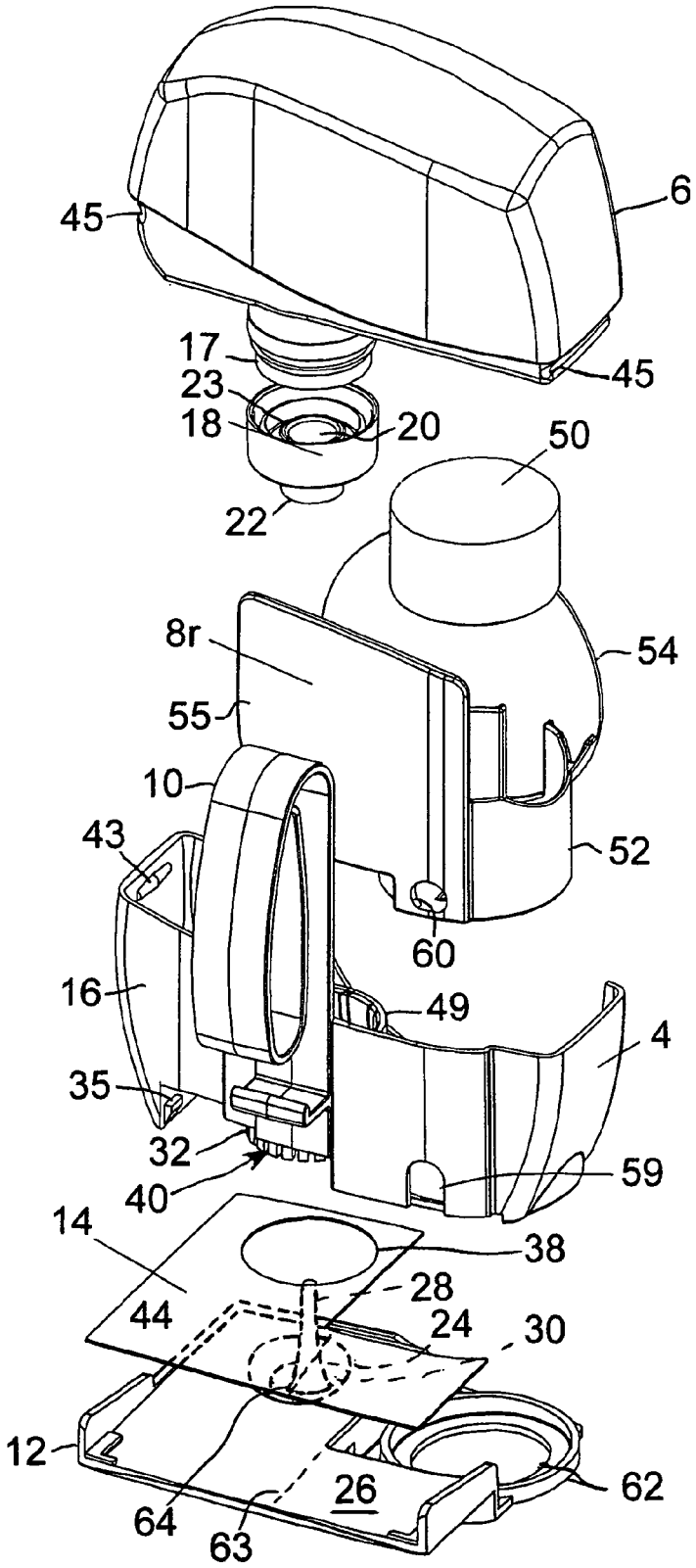
FIG. 6 is an exploded view of the device of FIG. 1.

As more clearly seen in FIGS. 2 and 6, a delivery plate 12, having a textile layer 14 on its upper surface, is attached to the underside of the support member 4 and extends to the rear of the rear wall 16. In use, plate 12 will extend underneath the rim of the toilet bowl so that flush water will splash over the textile layer 14.

Plate 12 may be configured to abut the side wall of the toilet bowl to ensure collection of sufficient water in the toilet bowls, particularly US style bowls, in which the flush water is directed to flow down the wall rather than cascade turbulently from the rim.

As will be described more fully hereinafter, the lavatory cleansing device 2 incorporates, in effect, two delivery systems, a first for delivering a liquid product and a second for delivering components from a solid product, while keeping the products separate and allowing for a single refill unit.

The liquid delivery system will be described first. Container 6 is typically molded of clear or semi-transparent PET or PVC. High density polyethylene or polypropylene may be used if the container contains, or is contacted by a bleach component, for example. Container 6 has an outlet opening 17 closed by a cap 18 which has a frangible seal 20 and a tubular collar 22 extending down below the seal 20. Prior to fracture, seal 20 extends across the inner end 23 of collar 22.

Delivery plate 12 molded of polypropylene has a cup 24 which depends downwardly from a main supporting surface 26. A spigot 28 projects up from the bottom wall 30 of the cup 24.

The layer 14 of the textile material lays on the supporting surface 26. Textile material layer 14 may be glued or welded to surface 26, for example by ultrasonic welding or held flat by spikes projecting up from surface 26, for example.

Textile layer 14 has an aperture 38 which coincides with the mouth of cup 24. Textile layer 14 need not fully surround cup 24. The requirement is to deliver liquid from the cup to the exposed area of the plate 26 and textile layer 14.

Main support member 4 has a capillary member 32 integrally formed on a bottom wall 36 of support member 4. Capillary member 32 extends through aperture 38 of textile layer 14, into the cup 24. Capillary member 32 is cylindrical, and has capillary channels 40 formed in its outer wall, facing the inner wall 42 of cup 24. Capillary channels 40 extend up to the underside of bottom wall 36, and along a thickened region of wall 36, forming an L-shape which will overlap the textile layer 14. Capillary channels 40 are positioned to deliver liquid onto the textile layer 14.

Delivery plate 12, with textile layer 14 in position, is clipped to support member 4, for example by nibs 35 integrally formed on the walls of support member 4, which clip under delivery plate 12.

In use, the container 6 is pushed into support member 4, spigot 28 displacing the frangible seal 20 of cap 18. A ledge 39 formed in the wall of container 6 rests on the upper edge 41 of support 4. Ribs 43 on the inside surface of support 4 engages in recesses 45 in the container wall. Liquid 5 will flow from the container 6 into cup 24, through collar 22. Liquid from cup 24 is ducted up onto the upper surface 44 of textile layer 14 by the capillary channels 40. Capillary channels 40 co-operate with the inner wall 42 of cup 24 to duct the liquid upwards, until it passes into the upper leg 46 of capillary channels 40, which extend over the fabric upper surface 44.

The liquid is then ducted away from the capillary channels 40 by the texture of the textile, to spread slowly over the surface 44. It is preferred that there is no substantial absorption into the textile layer, thus a hydrophobic treatment may be preferred. One example of a textile layer is knitted on a Karl Meyer Raschel Jacquard=RMJG 5 FNE Machine, Warp (Pillar) 150/36 Semi Dull Polyester (Flat) Back Bar (Top Creel) 1/167 Textured Polyester, Front Bar (Bottom Creel) 2/167 Textured polyester. The presently preferred material is a Jacquard knitted polyester of open weave, having

| Motions | A | B |
|---|---|---|
| Front Bar | Cut | Cut |
| Back Bar | Cut | Miss |

With a quality of 25.4 C.P.I.

Another fabric type is:

| Motions | A | B |
|---|---|---|
| Front Bar | Miss | Cut |
| Back Bar | Cut | Miss |

With a quality of 25.4 C.P.I.

This arrangement is particularly suited for use with viscous liquids. For less viscous liquids, the textile layer 14 may be dispensed with, and the upper surface 26 of plate 12 may be textured, for example with radial grooves, to duct liquid over the surface. Initially, the liquid from container 6 will fill the cup 24 only to just above the lower edge 47 of the collar 22. As the liquid is ducted out of the cup 24 by the capillary channels 40, the level of liquid in cup 24 falls below the edge 47, allowing air to enter container 6, and so allowing more liquid to flow from the container into cup 24 until edge 47 is covered again.

Container cap 18 fits in a cylinder 49 extending up from the wall 36. Grooves 51 are provided on the inside of the wall of cylinder 49 to allow air to enter cup 24. Wall 36 sits just clear of textile layer 14 to allow liquid 5 to flow out over the surface of the textile. It has been found that the spacing of the wall 36 from the supporting surface 26, and hence the degree of compression, if any, of the textile 14 affects the rate of delivery of the product from the well or cup 24. Hence some trial is required to optimize the spacing to suit the particular textile, liquid viscosity, etc.

When the device is installed in a toilet bowl, flush water will flow over upper surface 44 of textile layer 14, washing the liquid from the textile surface.

Preferably, the liquid viscosity, capillary channel size, fabric surface, etc. are tailored to replenish the surface 44 with a fresh dosage of liquid within 30 seconds to 10 minutes after the toilet bowl has been flushed.

The other component of the cleaning device 2 is a solid tablet 50 of bleaching agent and which may contain a colorant. Tabletted bleaching agents are well known.

Tablet 50 is held in cage 8 which fits in support member 4, under container 6. Cage 8 is moulded of polypropylene and forms a cylindrical cup 52 in which tablet 50 sits. Front and rear walls 54, 55 extend up from the cup 52 to embrace the container 6.

Cage 8 is configured to receive a small amount of flush water which percolates around tablet 50 to dissolve the bleach component and then drips into the toilet bowl. It is desirable to separate the bleach component from the liquid component of container 6 until they mix in the toilet bowl. Thus, flush water exits cage 8 at an aperture 56 in the bottom wall 58 of cup 52 as seen most clearly in FIG. 7.

Figure 7:
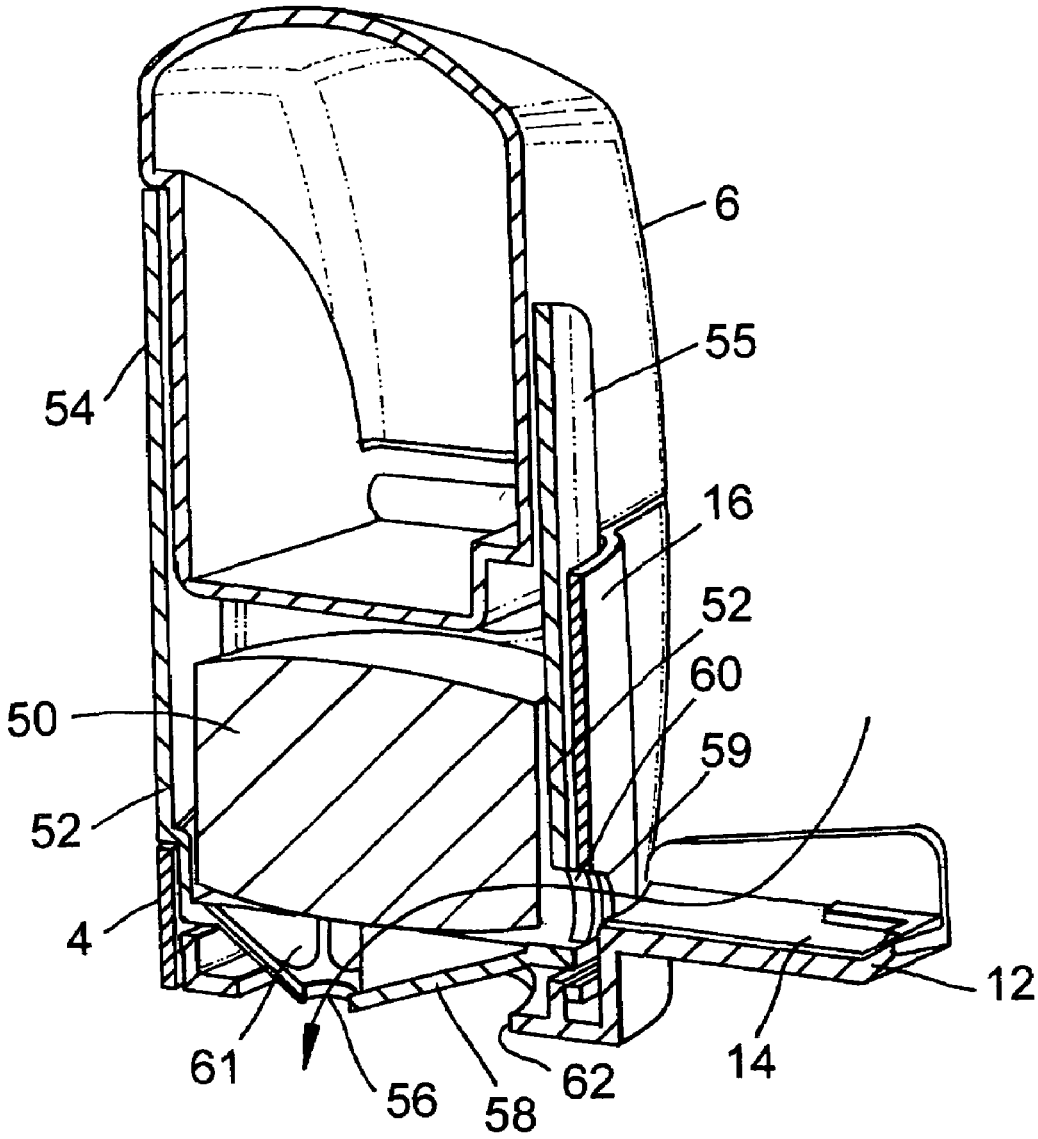
FIG. 7 is a perspective view on line C—C of FIG. 4.

Referring to FIG. 7, means are provided for causing flush water to wash over tablet 50. More particularly, an aperture 59 is formed in the rear wall 16 of support member 4, level with the textile layer 14 on the delivery plate 12. A corresponding aperture 60 in cylindrical cup 52 is aligned with aperture 59. Flush water flowing onto the textile layer 14 will splash through apertures 59, 60 and onto tablet 50. The water will then flow down and out through aperture 56. Tablet 50 is supported on ribs 61, to support the tablet over the conical bottom wall 58 of cup 52. Bottom wall 58 is aligned with an aperture 62 in delivery plate 12.

The textile layer 14 is fixed to delivery plate 12, which is then snapped in place on the underside of the supporting member 4. The cage 8 with a bleach tablet 50 in place is snapped onto the container 6, which is filled with liquid surfactant mixture and closed by cap 18. At the point of use, the consumer pushes the container/cage unit into the supporting member 4. Spigot 28 displaces seal 20, so that liquid fills cup 24 and is ducted onto the surface 44 of textile layer 14 as described above. The unit is suspended at the rim of a toilet bowl, plate 12 extending into the flow of flush water.

When the toilet is flushed, the flush water rapidly washes liquid 5 from the surface of the textile layer 14. Water will also pass through apertures 59, 60 to flow over bleach tablet 50 and wash bleach components out through aperture 56. Although the flush water may carry some of the surfactant formulation 5 over the bleach tablet 50, this will be washed out through aperture 56 and so there will not be prolonged contact in cup 52. In any event, any discoloration at tablet 50, for example, would not be visible to the user.

Plate 12 may be partitioned at line 63 of FIG. 6, or the fabric layer stopped short of the apertures 59 for example at line 64 of FIG. 6.

As mentioned above, tablet 50 may be in the form of a paste or gel, granules, etc. If desired, the tablet 50 may also be replaceable separately to the container 6.

As indicated above, it is desirable to provide a liquid formulation in container 6 comprising surfactant, perfume, dye and optionally a disinfecting agent. EP-A-775 741 describes such formulations.

A preferred formulation is

| | % by Weight |
|---|---|
| Anionic Surfactant | 26.5 |
| Nonionic Surfactant | 5.0 |
| Solvents | 10.0 |
| Antioxidant | 0.004 |
| Perfume | 10.0 |
| Dye | 0.0024 |
| Preservative | 0.1 |
| Natrosol Cellulose Thickener | 0.4* |
| Water | Balance |

The amount of natrosol is varied to achieve the desired viscosity, which typically is in the range 350 to 5000 centipoise, preferably 2000 to 4000, measured in a Broomfield LV viscosimeter, 20° C., spindle 2, speed 6.

Bleach tablet formulations are also well known in the art, and a typical formulation would include Sodium dichloroisocyanurate or trichlorocyanuric acid. The latter is available from Arch Chemicals Ltd. Under the trade mark Fi-Tabs.

As indicated above, a solid tablet of an acidic material for limescale removal or inhibition may be utilised, and a typical formulation would incorporate 90% by weight of citric acid.

The bleach (or acid) component may be presented as a liquid formulation, and delivered from container 6. A typical liquid bleach formulation would be

| | % by Weight |
|---|---|
| Sodium hypochlorite | 4.5 |
| Sodium hydroxide | 0.8 |
| Myristyl amine oxide | 10.0 |
| Sodium Xylene Sulphonate | 0.75 |
| Water | Balance |

This would have a viscosity of about 3500 cps.

The material of the container 6 would be bleach resistant. A bleach resistant colorant or dye may be incorporated in the liquid bleach formulation so that a user can readily tell when the container is empty.

Other liquid bleach formulations are described in U.S. Pat. No. 5,034,150, EP-A-233 666, EP-A-137 551, GB-A-1 466 560, for example.

An example of an acid formulation would be 10% hydrochloric acid, Tallow Ammonium Chloride type 1.5%, Alcohol Ethoxylate (non-ionic) 1.5%, dye, perfume and balance water to give a viscosity of about 500 Cps. Where the bleach or acid component is formulated as a liquid, then the surfactant/perfume/dye component may be formulated as a solid, using formulations well known in the art for solid rim sticks, comprising surfactant, solubility control agent (hydrophobe), perfume, colorant, electrolyte filler, etc.

Figure 9:
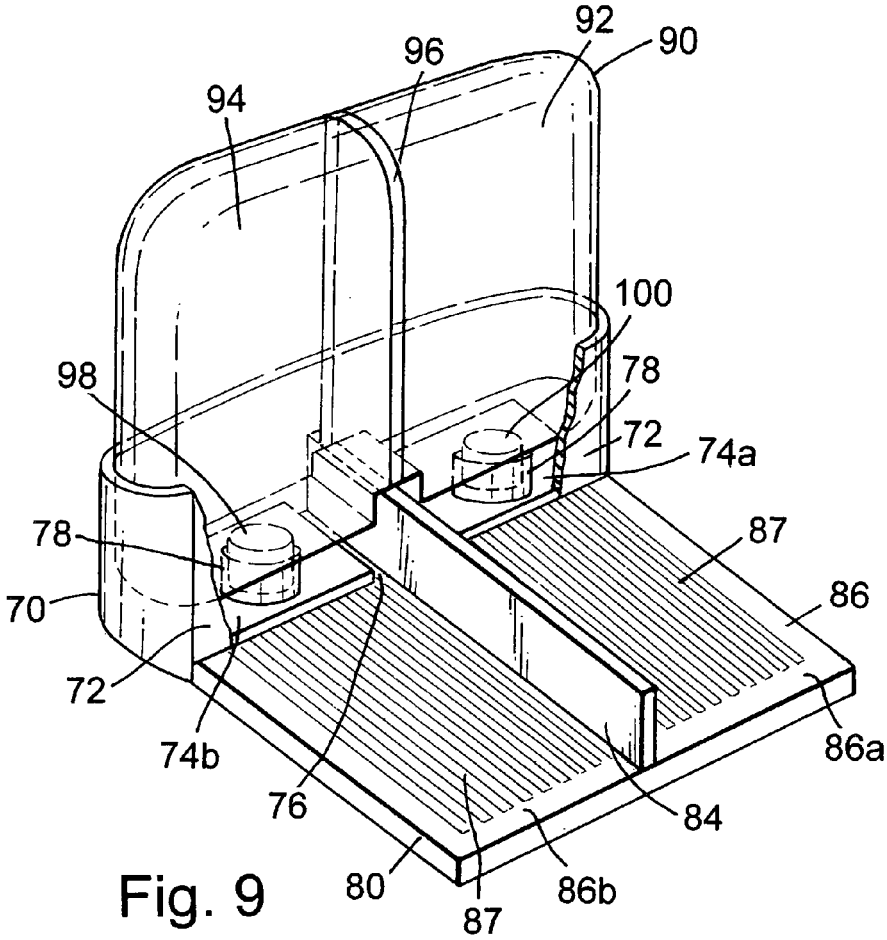
FIG. 9 is a perspective view of a second embodiment of the invention, in which two liquid compositions are dispensed.

The embodiment of FIG. 9 delivers two liquid compositions and is similar in construction to the liquid rim device seen in WO 00/42261 save that it delivers two liquid compositions, while maintaining them separate.

A support member 70 is shown with part of its rear wall 72 removed for clarity, and also the strap which is used to suspend the holder from the toilet bowl rim. A bottom wall 74 of the support member 70 is divided into two separate parts 74*a*, 74*b*, separated by a gap 76. A cylinder or collar 78 extends up from each bottom wall portion 74*a*, 74*b*, an aperture being provided in each wall portion 74*a*, 74*b*, within the area bound by the cylinder 78.

A delivery plate 80 is clipped to the underside of the wall 74.

Figure 10:
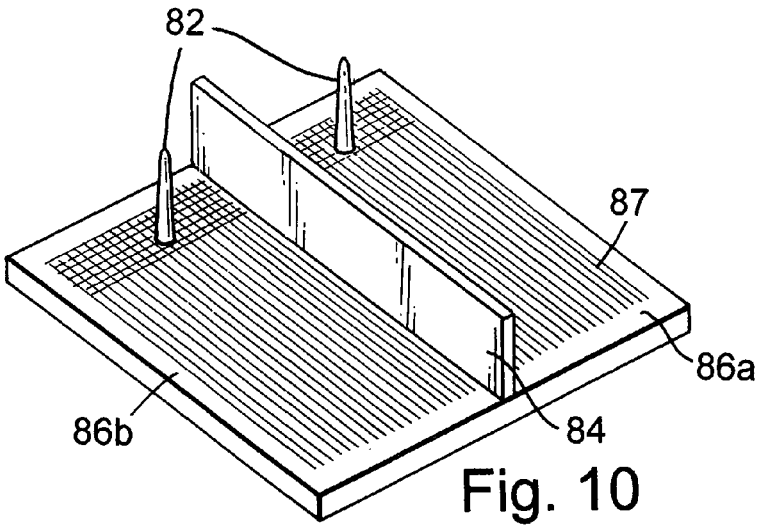
FIG. 10 is a plan view of the delivery plate of FIG. 9.

As seen in FIG. 10, plate 80 has a spigot 82 positioned to project up through the respective aperture in the wall 74.

A central dividing wall 84 divides the upper surface 86 of plate 80 into separate halves. A series of grooves or channels 87 extends away from the spigots 82.

A liquid container 90, which is generally transparent or translucent, has two separate compartments 92, 94, divided by a wall 96. It will be appreciated that container 90 may be formed as two separate members which are bonded together, or otherwise shaped to facilitate manufacture.

An outlet opening or neck 100, 98 on each compartment 92, 94 fits snugly in a respective cylinder 78, the spigot 82 displacing a frangible seal as the container is pushed down into the support member 70.

Liquids from the compartments 92, 94 then flow down onto the respective surface portion 86*a*, 86*b*, of the delivery plate 80. Dividing wall 84 serves to keep the liquids separate as they migrate along the channels 87.

The device functions generally as described in WO 00/42261 save that different liquid compositions are delivered onto the different delivery surfaces 86*a*, 86*b*, and are kept separated by the wall 84, until they are washed into the toilet cistern. The liquid compositions may be formulated as described above in relation to the first embodiment. Also, it will be appreciated that the liquid delivery systems may be as described in the first embodiment, using a cup below the delivery surface and a capillary system to deliver liquid onto the delivery surface, which could be a textile layer.

Figure 11:
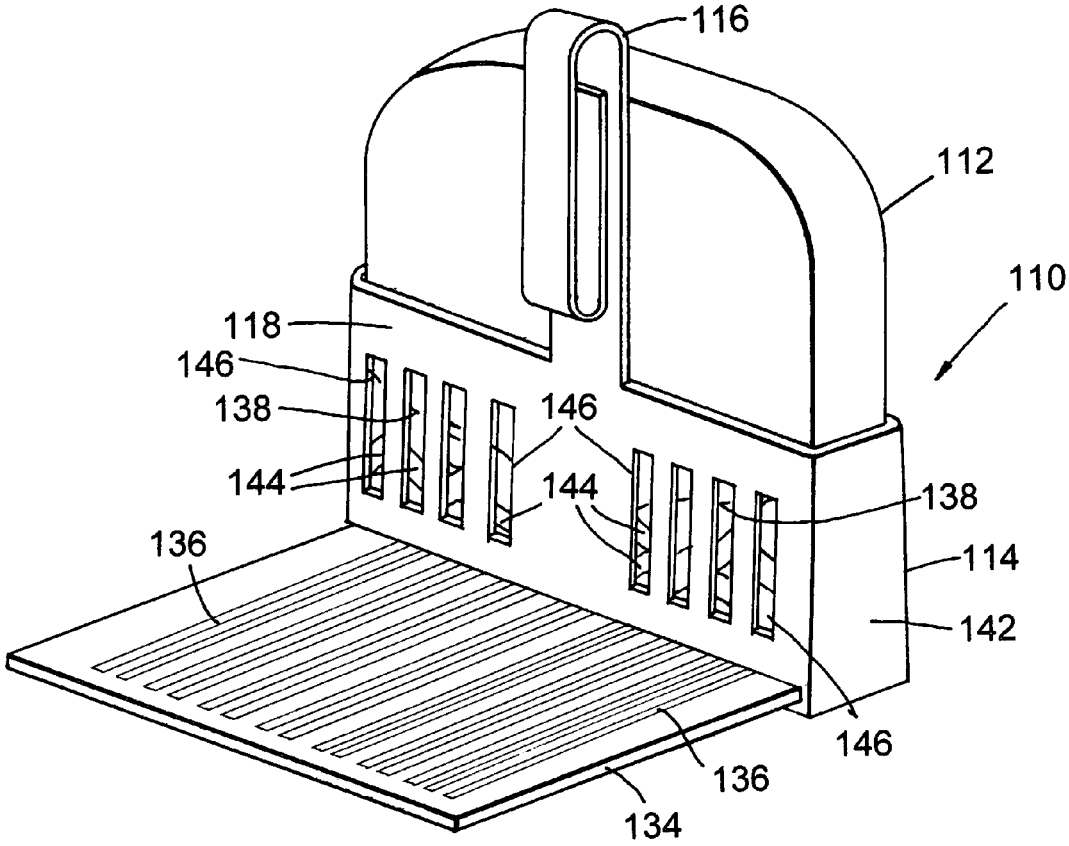
FIG. 11 is a rear perspective view of a third embodiment of the invention.
Figure 12:
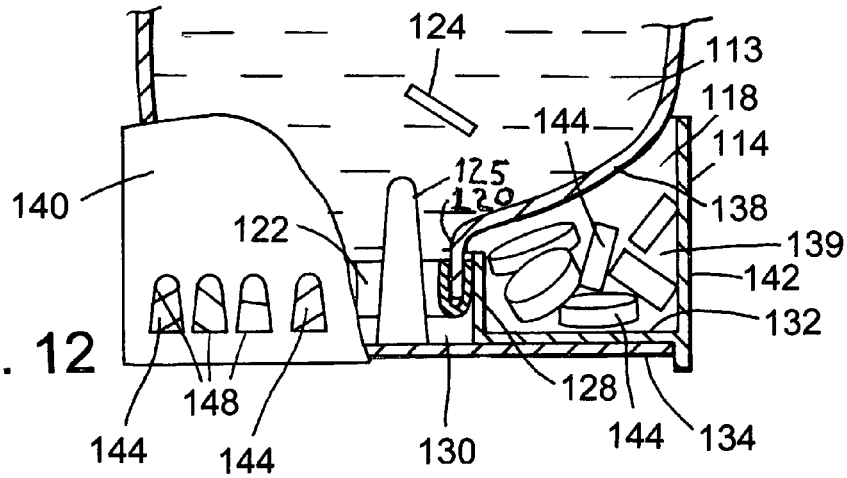
FIG. 12 is a front view partly cut away of the embodiment of FIG. 11.

In the embodiment of FIGS. 11 and 12, the support member itself forms a substantially enclosed space, i.e, a cage or housing for holding small tablets or pellets of a solid bleach formulation.

The drawings show a liquid dispensing device 110 similar in construction to the device seen in WO 00/42261. A container 112 of translucent polypropylene contains a liquid surfactant/dye/perfume mixture 113. Container 112 is held in a support member 114 which is clipped onto the rim of a toilet bowl by means of a flexible strap 116 which is integral with a rear wall 118 of the support member.

Container 112 has an outlet 120 which is temporarily closed by a cap 122. Cap 122 has a frangible seal 124 which, as seen in FIG. 12, is displaced by a spigot 125 when the container 112 is inserted in the support member 114. The remaining portion of cap 122 serves to form a seal between the outlet 120 and a cylindrical collar 128.

Collar 128 defines an opening 130 in a bottom wall 132 of the support member 114. Liquid from container 112 flows through outlet 120 onto a delivery plate 134 which is clipped in place under wall 132. Thus, outlet 120, collar 128 and plate 134 comprise delivery means enabling the liquid in the container to be delivered to the toilet bowl when the toilet is flushed. Spigot 125 projects up from plate 134. Grooves 136 extend away from the spigot 125 to duct liquid onto the exposed surface of plate 134, as described in the embodiment of FIGS. 9 and 10. Thus far, the arrangement is similar to that described in WO 00/42261.

The container 112 has sloping shoulders 138 to form a space 139 in the support member 114 which is bound by the shoulders 138, rear wall 118, front wall 140 and side walls 142.

Pellets 144 of a bleaching composition are housed in the space 139.

Vertically extending through holes or slots 146 are formed in the rear wall 118. These stop a few millimetres above the bottom wall 132. Slots 148 are formed in the front walls 140 and extend down to the bottom wall 132.

In use, flush water which impinges on plate 134 will also splash through the slots 146, into the space 139. This will wash over the tablets 144 to take some of the bleaching components into solution, and the resultant solution will drip out through the front slots 148. Thus, the holes or slots 146, 148 comprise means for flush water to wash over the tablets in space 139.

Figure 13:
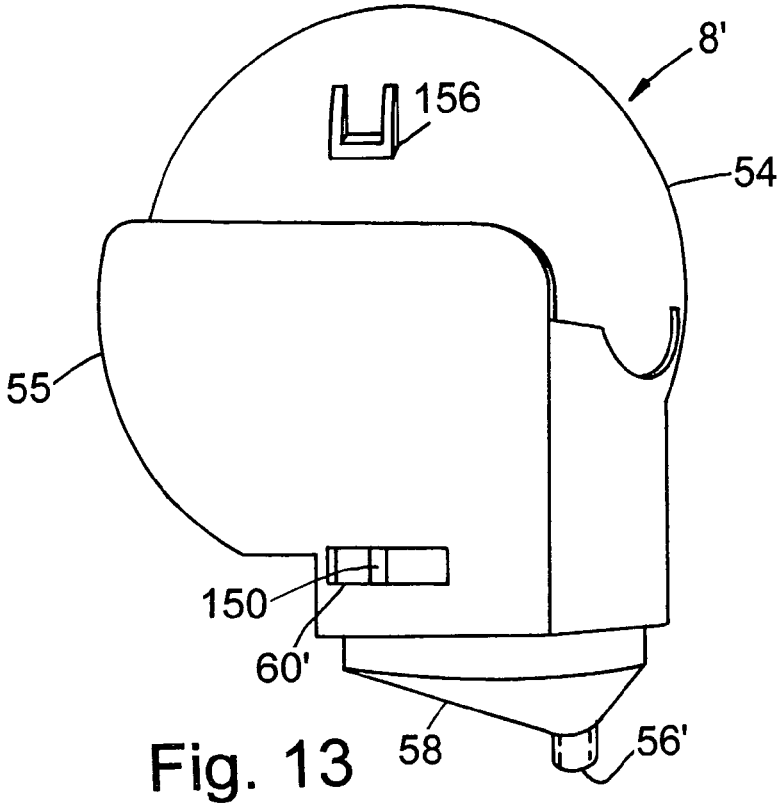
FIG. 13 is a side view of an embodiment of a modified tablet holder for the embodiment of FIGS. 1 to 8.
Figure 14:
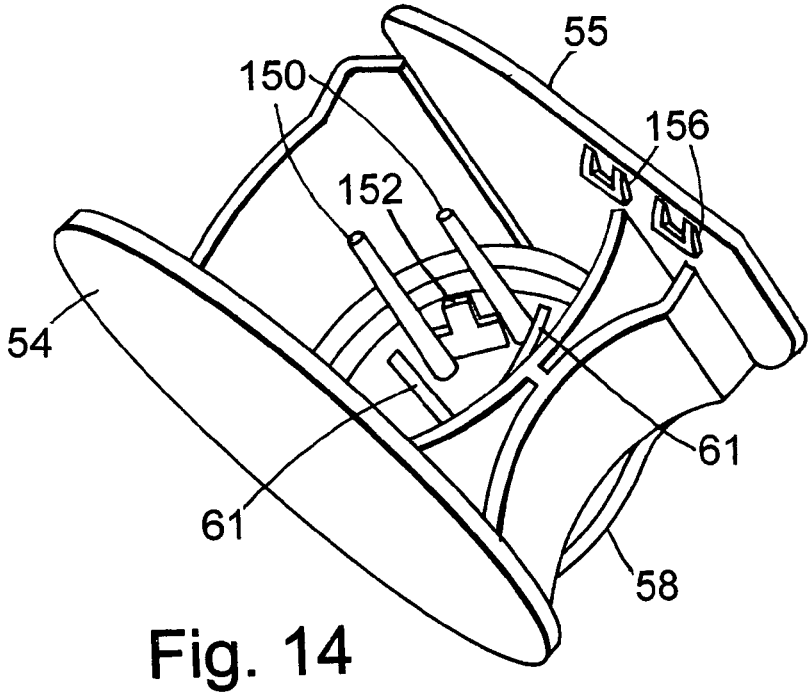
FIG. 14 is a perspective view from above of the holder of FIG. 13.
Figure 15:
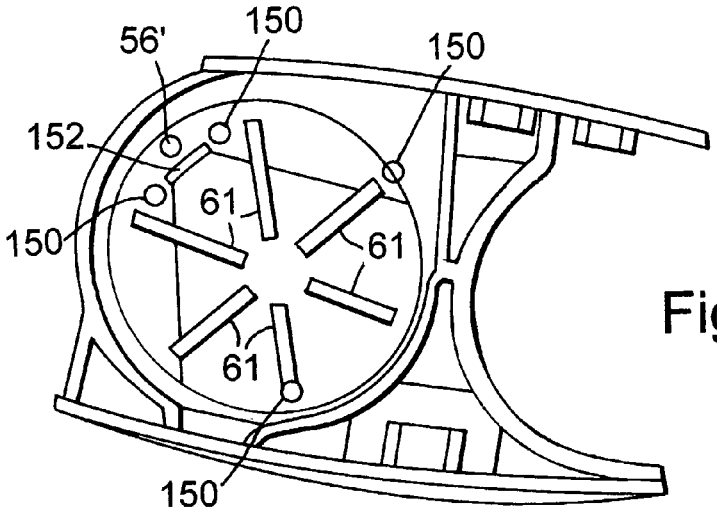
FIG. 15 is a plan view of the tablet holder of FIG. 13.

FIGS. 13 to 15 show a modified tablet holder for the embodiment of FIGS. 1 to 8. This tablet holder is arranged to hold the flush water, which enters the holder, in contact with the tablet for a short period of time prior to releasing it into the toilet bowl. By having a noticeable residence period in the tablet holder, the flush water will take components of the bleach block (or other block type in the holder) into solution in a more controlled manner. Also, by delaying the drainage of the formed solution into the toilet bowl, the constituents are less likely to be carried out of the bowl with the flushing water.

Figure 1:
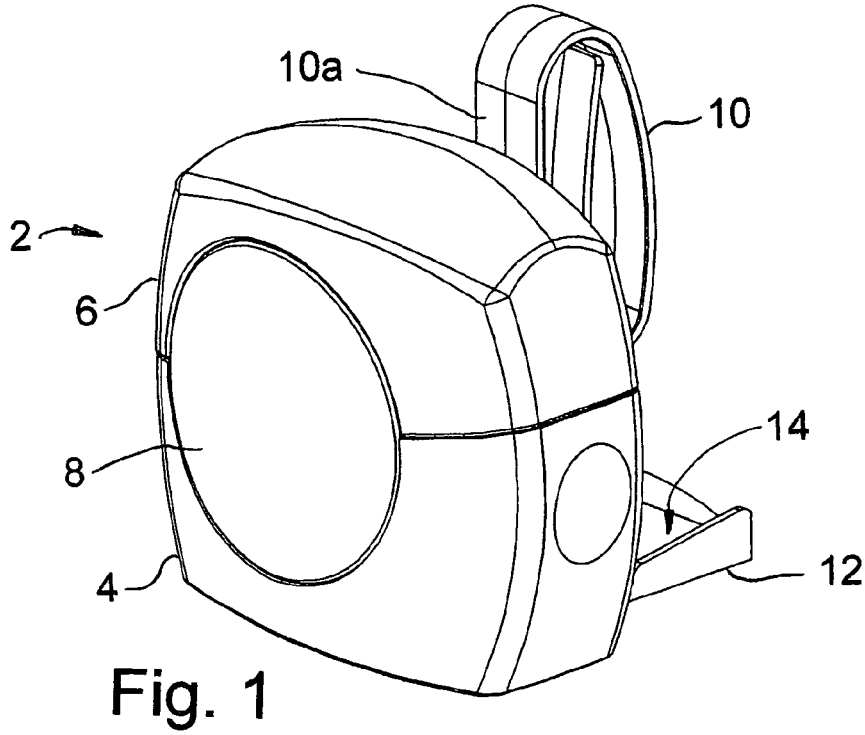
FIG. 1 is a front perspective view of a lavatory cleansing device forming a first embodiment of the invention.
Figure 16:
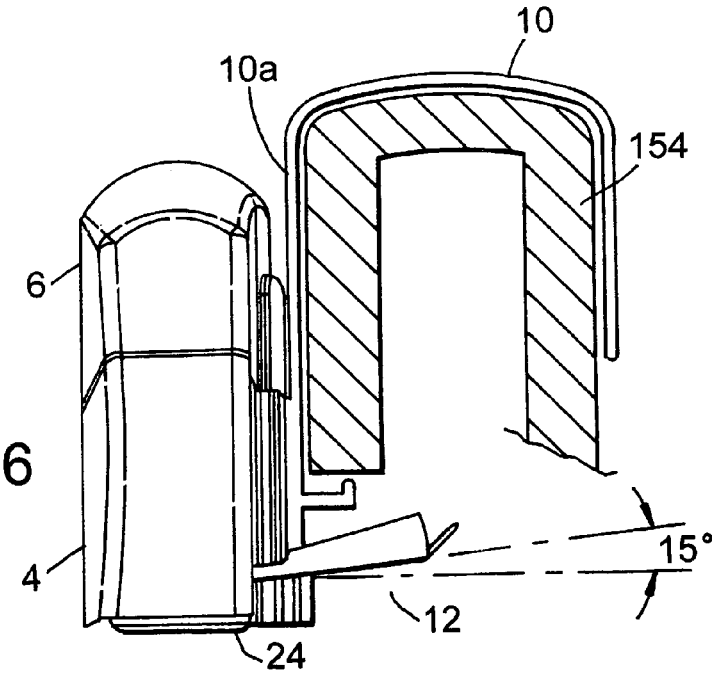
FIG. 16 is a side view corresponding to FIG. 3 and showing a sloping delivery plate and the device mounted on a rim of a toilet bowl.

To achieve a residence time in the tablet holder we provide an outlet aperture of small size, arranged to allow water to drain from the tablet holder in about 5 to 15 seconds. It is desirable to arrange for the solution to drip into the toilet bowl while there is still some turbulence in the water in the bowl but after the flow of water out of the bowl has ended. To ensure that a sufficient quantity of water enters the tablet holder, the plate 12 is sloped downwards towards the entry aperture 59, 60, preferably at an angle of about 10 to 20 degrees to the horizontal, and preferably about 15 degrees, as seen in FIG. 16. The horizontal may be taken as the perpendicular to the main strap portion 10*a* (FIGS. 1 and 2). It will be appreciated that the actual angle of the plate 12 to the horizontal will depend on the orientation adapted by the device when installed by the user on the toilet bowl rim 154 and this itself may also vary between bowl designs.

FIG. 13 shows a perspective view of the tablet holder 8' from the rear side (i.e. the side of the delivery plate 12 when installed) cf. the view in FIG. 6. Inlet aperture 60' aligns with the upper surface of the plate 12 or fabric layer 24 and aperture 59 in the rear wall of the holder 4 (see FIG. 6). Aperture 60' is dimensioned to allow the tablet holder 8' to fill to about the level of the aperture 60' during a flushing cycle. Water filling the tablet holder 8' eventually drains from the tablet holder through outlet aperture 56' in the bottom wall 58. In this embodiment, the outlet aperture is about 1.3 mm across, typically starting to drain a few seconds after the flush has stopped, and continuing to drain for several minutes, preferably ten minutes or more after the flush. Outlet aperture 56' will be smaller than inlet aperture 60'. The quantity of water in tablet holder 8' will depend on the amount of tablet left, but a quantity in the region of 5 $cm^3$ is preferred.

As with the embodiment of FIGS. 1 to 8, bottom wall 58 is dished, sloping down to the outlet aperture 56', and a tablet 8, is supported on radial ribs 61. A plurality of pins 150 extend up from the bottom wall 58 and the tablet is located between the pins 150. This ensures that the tablet is held clear of the inlet and outlet apertures 60', 56, to avoid blocking them, and water can access the side and underneath of the tablet. Also, a shield plate 152 further protects the outlet aperture 56' to prevent tablet particles blocking the aperture.

Nibs 156 engage in recesses in the sidewalls of container 6 to clip the cage 8' to the container, to form a refill unit.

Typical formulations for a bleach tablet are given in table 1.

TABLE 1

Document #: 798665

| | 1 | 2 | 3 | 4 | 5 | 6 | 7 | 8 | 9 | 10 | 11 | 12 |
|---|---|---|---|---|---|---|---|---|---|---|---|---|
| Ufaryl DL90 | | | | | 20 | 20 | | | | | 15 | 20 |
| Ufaryl DL80P | 20 | 17.5 | 17.5 | 15 | | | 20 | 20 | 17.5 | 20 | | |
| Hostapur SAS 93G | 20 | 17.5 | 17.5 | 15 | 20 | 20 | 20 | 20 | 17.5 | 20 | 15 | 20 |
| S.D.I.C. | 45 | 55 | 60 | 65 | 45 | 50 | 50 | 50 | 55 | 45 | 45 | 40 |
| Calcium Sulphate s.f.w. | 10.3 | | | 1.5 | 5.5 | | | 5.5 | 5.5 | 10.3 | 21.3 | 15.3 |
| Plasthall 4141 | 1 | 1 | 1 | 1 | 1 | 1 | 1 | 1 | 1 | 1 | 1.0 | 1 |
| Mineral Oil | 3.5 | 3 | 3 | 2.5 | 3.5 | 3 | 3.5 | 3.5 | 3.5 | 3.5 | 2.5 | 3.5 |
| Tytanpol R-002 | 0.2 | | | | — | | | | | 0.2 | 0.2 | 0.2 |
| Sodium Sulphate | | 6 | 1 | | 5 | 6 | 5.5 | | | | | |

| Material | Chemical Name |
|---|---|
| Unger Ufaryl DL90 | Sodium Alkylaryl Sulphanate (Sodium Dodecylbenzene Sulfonate) |
| Hostapur SAS 93G | Secondary alkane sulphonate, sodium salt (93%) |
| Ufaryl DL80P | Sodium Alkylaryl Sulphanate (Sodium Dodecylbenzene Sulfonate) |
| Sodium Sulphate | Sodium Sulphate |
| Mineral Oil | White mineral oil, or Paraffin Oil |
| Plasthall 4141 | Triethylene Glycol Caprate Caprylate |
| Calcium Sulphate s.f.w. | Gypsum, or Calcium Sulphate dihydrate |
| S.D.I.C. | Sodium Dichloroisocyanurate, dyhydrate |

Various modifications will be apparent to those skilled in the art and it is desired to include all such modifications as full within the scope of the accompanying claims.

What is claimed is:

1. A lavatory cleansing device for a toilet bowl, comprising a first container containing a first, liquid composition and delivery means for delivering the liquid composition to the toilet bowl when the toilet is flushed, the container being held in a support member having a strap for suspending the support member from the rim of the toilet bowl, wherein a space is provided in the support member under a shoulder of the container, and a second, solid composition is housed in the support member under the shoulder of the container and means is provided for flush water to wash over the second composition.

2. A lavatory cleansing device as claimed in claim 1, wherein the first composition comprises one or more of a surfactant, a dye and a perfume.

3. A lavatory cleansing device as claimed in claim 2, wherein the second composition contains a bleach.

4. A lavatory cleansing device as claims in claim 2, wherein the second composition contains an acidic component for limescale removal.

5. A lavatory composition as claimed in claim 2, wherein the delivery means comprises a delivery plate and, in use, the liquid composition is delivered onto the delivery plate and flush water washes the liquid composition from the delivery plate into the toilet bowl.

6. A lavatory cleansing device as claimed in claim 1, wherein the second composition includes a bleach.

7. A lavatory cleansing device as claimed in claim 1, wherein the second composition includes a colorant.

8. A lavatory cleansing device as claimed in claim 1, wherein the means for flush water to flow over the second composition comprise apertures in a wall of the support member.

9. A lavatory cleansing device as claimed in claim 1, wherein the first, liquid composition and the second, solid composition are kept separate until they have entered the toilet bowl from said device.

10. A lavatory cleansing device for a toilet bowl, comprising a first container containing a first, liquid composition, a delivery plate onto which the liquid composition is delivered in use and arranged so that flush water of the toilet washes the liquid from the delivery plate into the toilet bowl, the container being held in a support member having a strap for suspending the support member from the rim of the toilet bowl, wherein the container has a shoulder extending away from an outlet of the container, a second, solid composition is housed in the support member under the shoulder of the container and holes are provided in a wall of the support member through which flush water flows onto the second, solid composition.

11. A lavatory cleansing device for a toilet bowl, comprising a first container containing a first, liquid composition, the container having an outlet which is directed downwardly in use and a shoulder extending laterally of the outlet, a delivery plate below the container outlet and onto which the liquid composition flows in use and arranged so that flush water of the toilet washes the liquid from the delivery plate into the toilet bowl, the container being held in a support member having a strap for suspending the support member from the rim of the toilet bowl, wherein a second, solid composition is housed under the shoulder of the container and holes are provided in a wall of the support member through which flush water flows onto the second, solid composition.

* * * * *